United States Patent [19]

Fogarty et al.

[11] Patent Number: 4,540,375

[45] Date of Patent: Sep. 10, 1985

[54] GRAPHIC ARTS TOY

[76] Inventors: A. Edward Fogarty; Bonnie R. Fogarty, both of 3513 School Ave., Sarasota, Fla. 33579

[21] Appl. No.: 579,674

[22] Filed: Feb. 13, 1984

[51] Int. Cl.[3] ..... A63H 33/24; A63H 33/30

[52] U.S. Cl. ..... 446/146; 446/147; 446/475; 434/83; 242/96

[58] Field of Search ..... 434/83, 90, 91, 92, 434/84; 242/96, 137; 446/1, 70, 116, 144, 146, 147, 151, 86, 118, 124, 475, 489, 490, 491; 206/575; 156/163; 428/37, 39, 906

[56] References Cited

U.S. PATENT DOCUMENTS

| | | | |
|---|---|---|---|
| 510,178 | 12/1983 | König | 446/118 X |
| 2,504,669 | 4/1950 | Elliott et al. | 242/96 |
| 2,984,488 | 5/1961 | Kirchner | 434/83 X |
| 3,191,937 | 6/1965 | Kropinski | 446/124 X |
| 3,240,176 | 3/1966 | Morrison | 112/266 X |
| 3,545,658 | 12/1970 | Tanemura | 223/104 |
| 3,570,435 | 3/1971 | Morrison | 312/305 |
| 3,905,133 | 9/1975 | Charman | 434/83 |
| 4,041,637 | 8/1977 | Whitman | 446/72 |
| 4,158,296 | 6/1979 | Dunlop | 177/210 R |
| 4,227,335 | 10/1980 | Kuna et al. | 446/146 |
| 4,355,722 | 10/1982 | Iemmeyer | 446/86 X |

FOREIGN PATENT DOCUMENTS 2225582 12/1973 Fed. Rep. of Germany ..... 434/83

*Primary Examiner*—Robert A. Hafer
*Assistant Examiner*—D. Neal Muir
*Attorney, Agent, or Firm*—Benjamin P. Reese, II

[57] ABSTRACT

A graphic arts toy including a string retaining sketch pad, an elongated string, and means for storing, dispensing and retracting the string. The string retaining sketch pad comprises a flexible, plate-like element having a plurality of upwardly extending, flexible fingers on its top. The fingers are arrayed in equally spaced, parallel, transverse rows. The means for storing, dispensing and retracting the string comprises a string storage, dispensing and retracting pencil having a housing, a string storage dispensing and retracting reel rotatably mounted in the housing, and a string dispensing and retracting tube with one of its ends in the housing and the other of its ends exterior to the housing. When the tube is moved between a pair of fingers, the fingers are flexed apart and the string dispensed there between. The fingers return to their normal position to grip and hold the string after the tube moves to the next pair of fingers.

20 Claims, 14 Drawing Figures

GRAPHIC ARTS TOY

BACKGROUND OF THE INVENTION

This invention relates generally to graphic arts toys, and, particularly, to a graphic arts by including a string retaining sketch pad, an elongated string, and means for storing, dispensing and retracting the string.

Various graphic arts toys and the like which include a board, mat or the like for retaining string or yarn, an elongated string of yarn, and means for storing and dispensing the string of yarn to the board, mat or the like are well known in the toy and game industry. The existing graphic arts toys or the like of this general type which are known to the inventors use three different means for retaining the dispensed string or yarn on the board, mat or the like. First, certain of the existing graphic arts toys and the like include an adhesive layer which permanently bonds the dispensed string or yarn to the board, mat or the like. Second, certain other of the existing graphic arts toys and the like include pre-formed holes or slots in or through the board, mat or the like which receive and retain the dispensed string or yarn. Finally, special tools are included with certain other of the existing graphic arts toys or the like to punch holes or slots in or through the board, mat or the like and simultaneously force the string or yarn in or through such holes or slots.

The disadvantages of the graphic arts toys and the like including the means for retaining the dispensed string or yarn to the board, mat or the like which are discussed above are numerous. For example, an adhesive layer does not permit easy removal of the dispensed string or yarn from the board, mat or the like to correct user mistakes or erase a graphic arts design which is no longer desired by the user. Additionally, it is often difficult for younger children to easily use a graphic arts toy or the like which includes pre-formed holes or slots in the board, mat or the like for receiving and retaining the dispensed string or yarn. And, of course, a graphic arts toy or the like which includes a special tool for punching holes or slots in or through a board, mat or the like is often too dangerous for use by younger children.

It is desirable to have a graphic arts toy which overcomes the above discussed and other disadvantages of prior art graphic arts toys and the like. However, it is not believed that the prior art provides such a graphic arts toy.

SUMMARY OF THE INVENTION

The present invention provides a new and improved graphic arts toy including a string retaining sketch pad, an elongated string, and means for storing, dispensing and retracting the string.

The graphic arts toy of the present invention comprises a base having a string retaining sketch pad mounted thereon, an elongated, flexible string, and a string storage, dispensing and retracting pencil. The string storage, dispensing and retracting pencil comprises a housing, a reel rotatably mounted in the interior of the housing, and a string dispensing and retracting tube having one of its ends mounted in the interior of the housing and the other of the ends positioned exterior to the housing. The string is moveably positioned in the interior of the housing and tube with one of its ends fastened to the reel and the other of its ends positioned exterior to the housing and tube. The end of the string which is positioned exterior to the housing and tube has an anchor fastened thereon. The reel has a crank handle positioned exterior to the housing.

The string retaining sketch pad comprises a flexible, plate-like element having a plurality of upwardly extending, flexible fingers on the top thereof. The fingers are configured as right circular cylinders and arrayed in equally spaced, parallel, transverse rows. When the user of the graphic arts toy moves the string storage, dispensing and retracting pencil between a pair of the upwardly extending, flexible fingers, the fingers are bent over and apart and the string dispensed there between. After the string is dispensed, the fingers return to their normal position to grip the string and hold it in position. The user of the graphic arts toy can move the string dispensing and retracting tube in any direction and at any angle on the sketch pad because of the flexibility of the upwardly extending fingers.

These and many other advantages, features and objects of the present invention will be apparent from the following brief description of the drawings, description of the preferred embodiment and claims, and the accompanying drawings.

DETAILED DESCRIPTION OF THE PREFERRED EMBODIMENT

The preferred embodiment of the graphic arts toy of the present invention is illustrated in FIGS. 1–14.

Figure 1:
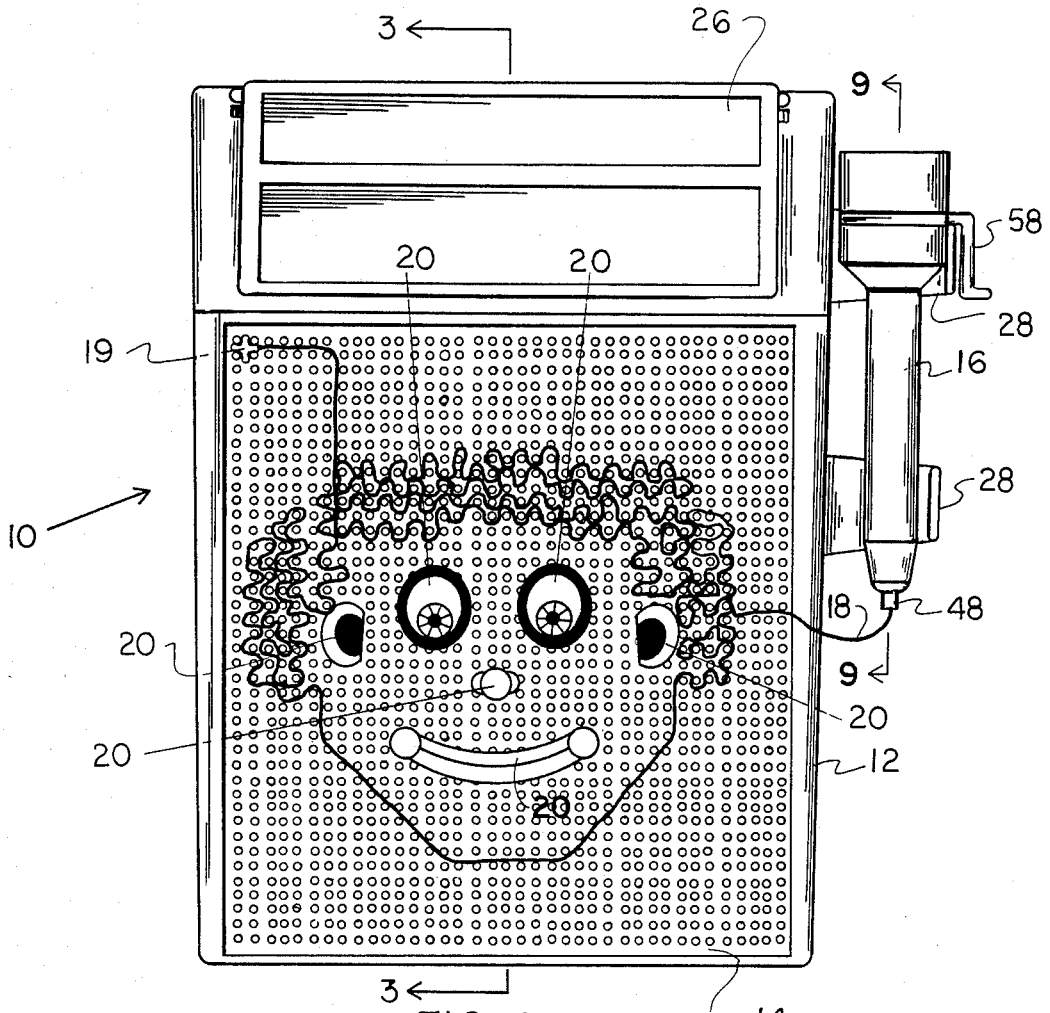
FIG. 1 is a top plan view of the preferred embodiment of the graphic arts toy of the present invention.
Figure 2:
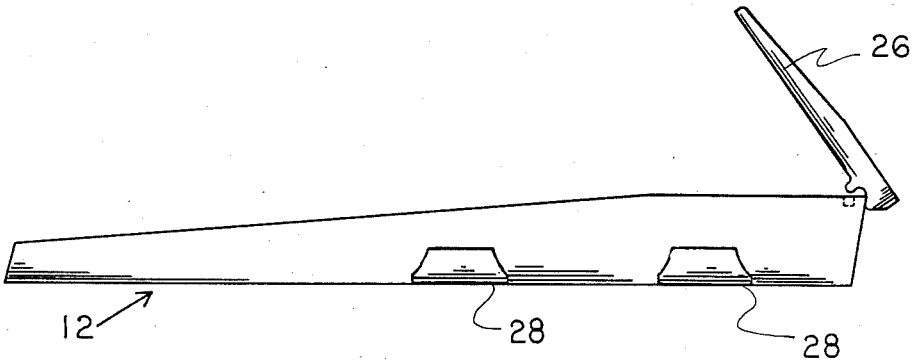
FIG. 2 is a right side elevational view of the base of the graphic arts toy illustrated in FIG. 1.
Figure 3:
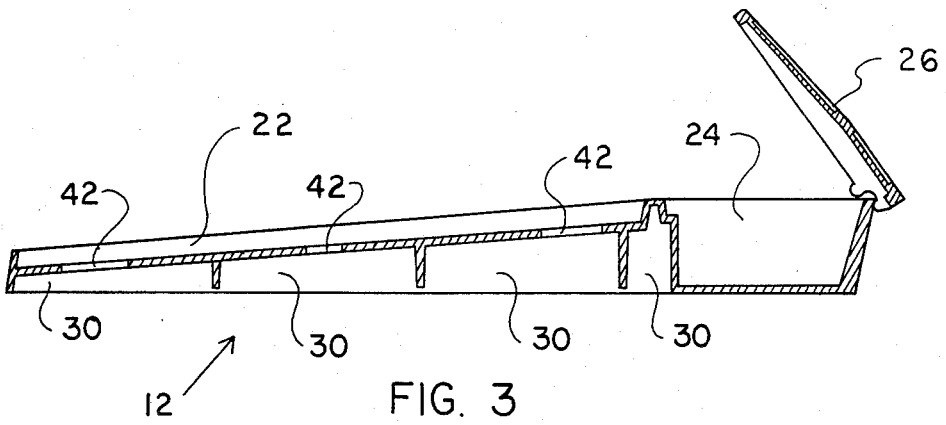
FIG. 3 is a sectional view of the base of the graphic arts toy taken along line 3—3 in FIG. 1.

Referring initially to FIG. 1, the graphic arts toy 10 comprises a base 12, a string retaining sketch pad 14 mounted on the base 12, a string storage, dispensing and retracting pencil 16, an elongated flexible string 18 having one of its ends connected in the interior of the pencil 16, an achor 19 fastened to the free end of the string 18, and a plurality of play pieces 20. Since the primary function of the base 12 is to support the sketch pad 14, the base 12 is formed from a high impact strength polystrene or another suitable rigid material. Various geometrical shapes are possible for the base 12. However, it is preferable to form the base 12 as an essentially wedge-shaped body having a first upper cavity 22 which holds the sketch pad 14, a second upper cavity 24 for storage of the play pieces 20 between periods of use, a hinged lid 26 which opens to provide access to and closes to cover the second upper cavity 24, and a pair of cantilever support brackets 28 which hold the pencil 16 between periods of use. As illustrated in FIG. 3, the base 12 may be formed with a plurality of lower cavities 30 to reduce manufacturing cost and weight.

Figure 4:
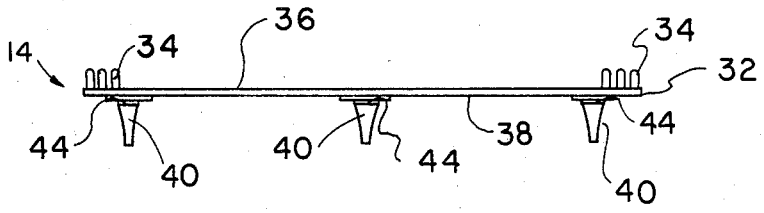
FIG. 4 is an elevational view of the string retaining sketch pad of the graphic arts toy illustrated in FIG. 1.

Referring now to FIGS. 1 and 4, the string retaining sketch pad 14 comprises a plate-like element 32 having a plurality of upwardly extending fingers 34 on its top 36. Only a limited number of such fingers 34 are illustrated in FIG. 4 to simplify the drawing. While various geometrical shapes are possible for the fingers 34, it is preferable to provide the fingers 34 as right circular cylinders which are integrally formed with the plate-like element 32. Referring specifically to FIG. 4, the bottom 38 of the plate-like element 32 has a plurality of downwardly extending pegs 40 which are appropriately positioned to snap into a plurality of holes 42 in the base 12, and, thereby, fasten the sketch pad 14 in the first upper cavity 22 of the base 12. To facilitate snap fastening, it is preferable to intergrally form each of the pegs 40 as a tapered circular cylinder having a circumferential groove 44 near its base. In such case, each of the holes 42 in the base 12 is formed as a right circular cylinder.

The upwardly extending fingers 34 on the top 36 of the plate-like element 32 are positioned at the intersections of equally spaced, imaginary, parallel lines running in transverse directions. The spacing between the imaginary lines is selected such that the resulting spacing between adjacent rows of fingers 34 will be slightly smaller than the uncompressed diameter of the string 18. The entire sketch pad 14 is formed from an elastic material, such as soft natural or synthetic rubber. The use of an elastic material for the sketch pad 13 imparts flexibility to the fingers 34 and further facilitates snap fastening between the pegs 40 on the bottom 38 of the plate-like element 32 and the holes 42 in the base 12.

Figure 9:
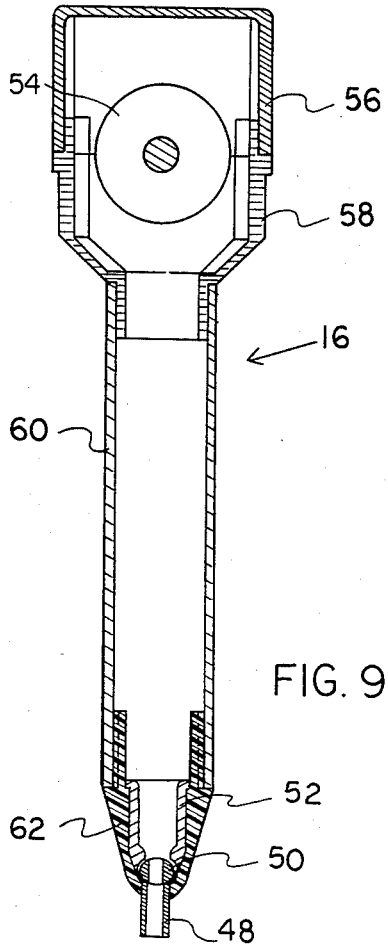
FIG. 9 is a sectional view of the string storage, dispensing and retracting pencil of the graphic arts toy taken along line 9—9 in FIG. 1.
Figure 10:
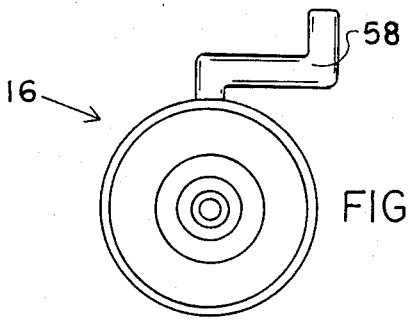
FIG. 10 is a bottom plan view of the string storage, dispensing and retracting pencil of the graphic arts toy illustrated in FIG. 1.
Figure 11:
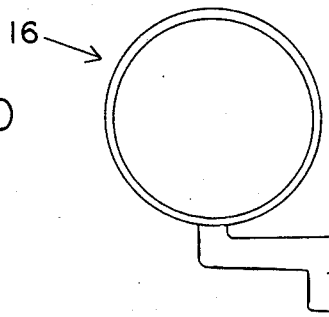
FIG. 11 is a top plan view of the string storage, dispensing and retracting pencil of the graphic arts toy illustrated in FIG. 1.
Figure 12:
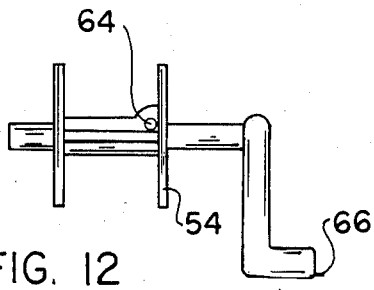
FIG. 12 is a top plan view of the reel from the string storage, dispensing and retracting pencil of the graphic arts toy illustrated in FIG. 1.
Figure 13:
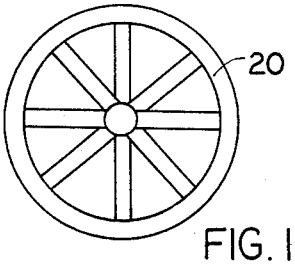
FIG. 13 is a top plan view of a typical play piece of the graphic arts toy illustrated in FIG. 1.
Figure 14:
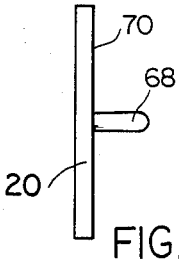
FIG. 14 is a side elevational view of the play piece illustrated in FIG. 13.

Referring now to FIGS. 8–12, the string storage, dispensing and retracting pencil 16 comprises a housing 46 simulating the appearance of a conventional lead pencil, a string dispensing and retracting tube 48 which simulates the appearance of a conventional pencil lead, an O-ring 50 mounted in the interior of the housing 46, a string dispensing and retracting tube and O-ring retainer 52 mounted in the interior of the housing 46, and a string storage, dispensing and retracting reel 54 rotatably mounted in the interior of the housing 46. The housing 46 is formed from a high impact strength polystrene or another suitable rigid material. As best illustrated in FIG. 9, the housing 46 can be formed as several different parts simulating the various parts of a conventional pencil, such as an eraser top 56, an eraser bottom 58, a pencil tube 60, and a pencil point 62, for convenience of manufacture.

The string dispensing and retracting tube 48 is formed from a rigid material, such as high impact strength polystrene or steel, and has an internal diameter which is slightly larger than the uncompressed diameter of the string 18. The O-ring 50 is formed from an elastic material, such as soft natural or synthetic rubber, and has an internal diameter which is slightly smaller than the uncompressed diameter of the string 18. As illustrated in FIG. 9, the lower end of the retainer 52 and the upper end of the tube 48 are geometrically configured to surround the O-ring 50 when the retainer 52 is pressure fitted in the interior of the housing 46.

During manufacture of the graphic arts toy 10, one end of the string 18 is passed through a hole 64 on the string storage, dispensing and retracting reel 54 rotatably mounted in the interior of the housing 46 of the string storage, dispensing and retracting pencil 16 and tied or otherwise fastened to the reel 54. The majority of the length of the string 18 is wound onto the reel 54 by turning its crank handle 66 positioned exterior to the housing 46. The free end of the string 18 is passed through the concentric bores of the retainer 52, O-ring 50 and tube 48 and extends outside the housing 46. Then, the anchor 19 is fastened onto the free end of the string 18 by conventional means. As best illustrated in FIG. 7, the anchor 19 is preferably formed in the shape of a Greek cross such that it not only prevents the free end of the string 18 from retracting into the housing 46 of the pencil 16 but also holds the free end of the string 18 between any four adjacent surrounding fingers 34 on the top 36 of the plate-like element 32 of the string retaining sketch pad 14.

Any conventional string or yarn having sufficient flexibility for creation of complex graphic designs is suitable for use as the string 18. It is preferable, however, that the string 18 be slightly compressible. But, compressibility it is not a necessary characteristic of the string 18 since the fingers 34 and O-ring 48 are flexible. Finally, referring to FIGS. 13 and 14, a typical play piece 20 is illustrated. The play piece 20 can be formed in various geometrical shapes, such as eyes, ears, a nose or the like, from high impact strength polystrene or another suitable rigid material and has at least one intergrally formed peg 68 on its bottom 70 to anchor the play piece 20 to the string retaining sketch pad 14. The peg 68 can have a cross section which is either circular or in the shape of a Greek cross.

Having described the structure of the graphic arts toy 10, its use will now be described. Returning to FIGS. 1, 5, 6 and 7, the user of the graphic arts toy 10 presses the anchor 19 on the free end of the string 18 between four of the upwardly extending fingers 34 at the desired location on the top 36 of the plate-like element 32 of the string retaining sketch pad 14. Then, the user grasps the string storage, dispensing and retracting pencil 16 between the thumb and fingers of his or her writing hand and moves the string dispensing and retracting tube 48 of the pencil 16 between the rows of fingers 34 on the sketch pad 14 in a manner similar to that of writing on a conventional sketch pad with a conventional lead pencil. As the tube 48 moves between each pair of fingers 34, the tube 48 bends those fingers 34 over and apart to open the space there between and dispenses a portion of the string 18 into that space. After that portion of the string 18 has been dispensed into that space, those fingers 34 return to their normal upright positions and grip that portion of the string 18 to hold it into position as the tube 48 moves forward to a new pair of fingers 34.

Figure 5:
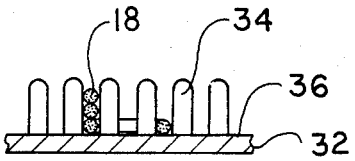
FIG. 5 is an elevational view of one portion of the string retaining sketch pad and one portion of the string of the graphic arts toy illustrated in FIG. 1.
Figure 6:
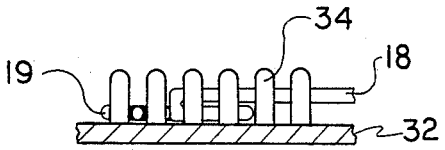
FIG. 6 is an elevational view of another portion of the string retaining sketch pad and another portion of the string of the graphic arts toy illustrated in FIG. 1.
Figure 7:
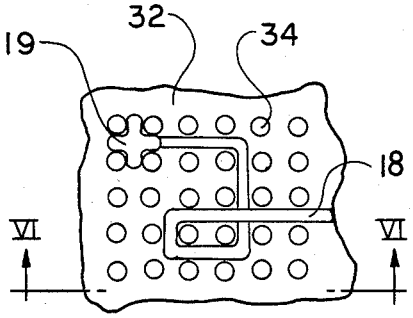
FIG. 7 is a top plan view of those portions of the string retaining sketch pad and string which are illustrated in FIG. 6.
Figure 8:
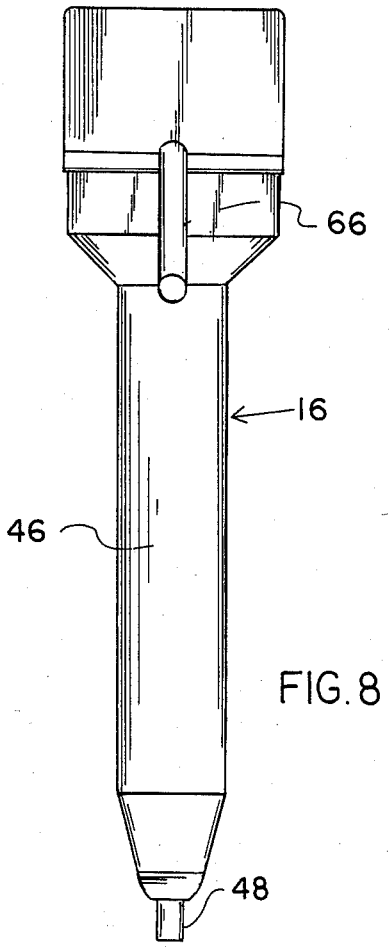
FIG. 8 is a side elevational view of the string storage, dispensing and retracting pencil of the graphic arts toy illustrated in FIG. 1.

Since the fingers 34 are flexible, the user of the graphic arts toy 10 can move the string dispensing and retracting tube 48 in any direction and at any angle on the sketch pad 14 to create various graphic designs which are limited only by the imagination and skill of the user, including graphic designs which require newly dispensed portions of the string 18 to cross over or lay on previously dispensed portions of the string 18 as best illustrated in FIGS. 5 and 7. The user would have only limited graphic design capability if rigid fingers were substituted for the flexible fingers 34 on the sketch pad 14 since only right angle turns are possible with rigid fingers. And, of course, since rigid fingers are not capable of bending over and apart when the tube 48 passes there between and returning to their normal upright positions after the tube 48 passes there between to grip that portion of the string 18 dispensed by the tube 48 in the manner described above, cross overs and the like would not be easy to accomplish if rigid fingers were substituted for the flexible fingers 34.

If desired, the user of the graphic arts toy 10 can enhance his or her graphic design by snapping one or more play pieces 20 onto the sketch pad 14. Finally, if the user of the graphic arts toy 10 desires to erase all or any portion of his or her graphic design, he or she simply turns the crank handle 66 of the reel 54 to retract the string 18 into the interior of the housing 46 of the string storage, dispensing and retracting pencil 16. Throughout the string dispensing and retracting processes, the O-ring 50 maintains sufficient force on the string 18 to prevent tangles and the like from occurring in the interior of the housing 46.

While the present invention has been disclosed in connection with its preferred embodiment, it should be understood that there may be other embodiments which fall within the scope and spirit of the invention as defined by the claims.

We claim:

1. A graphic arts toy, comprising:

a plate-like element having a plurality of upwardly extending, flexible fingers, said fingers being arrayed in equally spaced, parallel, transverse rows;

an elongated flexible string;

means for storing, dispensing and retracting said string, including a housing which is manually moveable over said plate-like element, a reel rotatably mounted in the interior of said housing, said reel having one end of said string fastened thereto, a string dispensing and retracting tube, said tube having one of its ends positioned in the interior of said housing and the other of its ends extending outward from said housing and said string moveably positioned in its bore, and manually operable means on the exterior of said housing for rotating said reel to retract said string;

means for preventing the free end of said string from retracting into the interior of said housing; and means for fastening the free end of said string to said plate-like element.

2. A graphic arts toy as recited in claim 1, wherein said fingers are right circular cylinders.

3. A graphic arts toy as recited in claim 1, wherein said means for preventing the free end of said string from retracting into the interior of said housing and said means for fastening the free end of said string to said plate-like element is a rigid cross fastened to the free end of said string.

4. A graphic arts toy as recited in claim 1, further comprising an O-ring mounted above said end of said tube positioned in the interior of said housing, said O-ring having said string moveably positioned in its bore.

5. A graphic arts toy as recited in claim 1, wherein said plate-like element is flexible.

6. A graphic arts toy as recited in claim 5, wherein said plate-like element is mounted on a base.

7. A graphic arts toy as recited in claim 6, wherein said base has an upper cavity.

8. A graphic arts toy as recited in claim 7, wherein said base has a hinged lid which covers said cavity.

9. A graphic arts toy as recited in claim 8, further comprising an cantilever support bracket on said base.

10. A graphic arts toy as recited in claim 1, further comprising a play piece including a downwardly extending peg or the bottom thereof.

11. A graphic arts toy, comprising:

a base;

a string retaining sketch pad, including a flexible, plate-like element having a plurality of upwardly extending, flexible fingers arrayed in equally spaced, parallel, transverse rows on the top thereof, said sketch pad being mounted on said base;

a string storage, dispensing and retracting pencil including a housing, a reel rotatably mounted in said housing, said reel having a crank handle positioned exterior to said housing, a string dispensing and retracting tube having one of its ends positioned in the interior of said housing and the other of its ends extending outward from said housing, and means for retaining said tube in said housing;

an elongated flexible string having one of its ends fastened to said reel and the other of its ends positioned external to said housing, said string being moveably positioned in the bore of said tube; and an anchor fastened to said end of said string positioned external to said housing.

12. A graphic arts toy as recited in claim 11, wherein said fingers are right circular cylinders.

13. A graphic arts toy as recited in claim 11, further comprising an O-ring mounted above said end of said tube positioned in the interior of said housing, said O-ring having said string moveably positioned in its bore.

14. A graphic arts toy as recited in claim 13, wherein said means for retaining said tube in said housing is a retainer which is pressure fitted in the interior of said housing above said O-ring, said retainer having a bore and said string being moveably positioned in said bore.

15. A graphic arts toy as recited in claim 11, wherein said plate-like element has a plurality of downwardly extending pegs on the bottom thereof and said base has a plurality of holes for receipt of said pegs.

16. A graphic arts toy as recited in claim 15, wherein said pegs are tapered cylinders.

17. A graphic arts toy as recited in claim 11, wherein said base has an upper cavity.

18. A graphic arts toy as recited in claim 17, wherein said base has a hinged lid which covers said cavity.

19. A graphic arts toy as recited in claim 18, further comprising a cantilever support bracket mounted on said base.

20. A graphic arts toy as recited in claim 11, further comprising a play piece including a downwardly extending peg on the bottom thereof.

* * * * *